US008256537B2

(12) United States Patent
Adam

(10) Patent No.: US 8,256,537 B2
(45) Date of Patent: Sep. 4, 2012

(54) BLASTING LATERAL HOLES FROM EXISTING WELL BORES

(76) Inventor: John Adam, Luling, TX (US)

( * ) Notice: Subject to any disclaimer, the term of this patent is extended or adjusted under 35 U.S.C. 154(b) by 162 days.

(21) Appl. No.: 12/706,712

(22) Filed: Feb. 17, 2010

(65) Prior Publication Data

US 2011/0198087 A1 Aug. 18, 2011

Related U.S. Application Data

(60) Provisional application No. 61/152,885, filed on Feb. 16, 2009.

(51) Int. Cl.
*E21B 7/08* (2006.01)

(52) U.S. Cl. ..... 175/62; 166/313; 166/50; 175/77

(58) Field of Classification Search ..... 166/298, 166/313, 50, 117.5; 175/62, 77, 262, 424
See application file for complete search history.

(56) References Cited

U.S. PATENT DOCUMENTS

| | | | | |
|---|---|---|---|---|
| 4,391,337 | A | 7/1983 | Ford | |
| 4,537,256 | A | 8/1985 | Beard | |
| 4,557,329 | A | 12/1985 | Savard | |
| 4,886,116 | A | 12/1989 | Garrison | |
| 5,445,220 | A | 8/1995 | Gurevich | |
| 5,531,164 | A | 7/1996 | Mosley | |
| 5,700,969 | A | 12/1997 | Mosley | |
| 6,237,701 | B1 | 5/2001 | Kolle | |
| 6,854,518 | B1 | 2/2005 | Senyard | |
| 6,865,792 | B2 | 3/2005 | Kash | |
| 6,929,066 | B2 | 8/2005 | Hill | |
| 7,025,139 | B2 | 4/2006 | Khomynets | |
| 7,246,548 | B2 | 7/2007 | Kash | |
| 7,357,182 | B2 | 4/2008 | Hunt | |
| 7,527,092 | B2 | 5/2009 | McAfee | |
| 7,546,876 | B2 | 6/2009 | McAfee | |
| 7,600,562 | B2 | 10/2009 | Christian | |
| 7,635,027 | B2 | 12/2009 | Rankin | |
| 7,637,317 | B1 | 12/2009 | Hernandez | |
| 7,650,947 | B2 | 1/2010 | Henke | |
| 2002/0023781 | A1* | 2/2002 | Peters | 175/67 |
| 2009/0101414 | A1* | 4/2009 | Brunet et al. | 175/62 |
| 2010/0270080 | A1* | 10/2010 | Perry et al. | 175/62 |

* cited by examiner

*Primary Examiner* — William P Neuder
(74) *Attorney, Agent, or Firm* — Tim Headley

(57) ABSTRACT

A system for blasting lateral holes in the formation around a well bore, the well bore containing production casing and production tubing inside the producting casing. The system includes: a coiled tubing system including a first pump for pumping under pressure cutting fluid; coiled tubing for inserting into the production tubing; a flexible hose having a first end attached to the bottom end of the coiled tubing; a jetting nozzle attached to a second end of the flexible hose; and a deflection shoe adapted for attaching to the bottom of the production tubing. The system further comprises a centering system for centering the coiled tubing within the production tubing; a fluid transport system comprising a second pump and tubing adapted for pumping circulating fluid through the production casing; and a flow-back system comprising tubing adapted for receiving spent cutting fluid out of the production casing.

7 Claims, 5 Drawing Sheets

BLASTING LATERAL HOLES FROM EXISTING WELL BORES

CROSS-REFERENCES TO RELATED APPLICATIONS

This patent application claims the benefit of provisional patent application serial number 61/152,885, filed Feb. 16, 2009.

STATEMENT REGARDING FEDERALLY SPONSORED RESEARCH OR DEVELOPMENT

None.

REFERENCE TO A "SEQUENCE LISTING," A TABLE, OR A COMPUTER PROGRAM LISTING APPENDIX SUBMITTED ON A COMPACT DISC AND AN INCORPORATION BY REFERENCE OF THE MATERIAL ON THE COMPACT DISC

None.

BACKGROUND OF THE INVENTION (1) Field of the Invention

The invention relates to methods for increasing production from oil and gas wells.

(2) Description of the Related Art

A key issue facing most oil and gas producers is how to increase their production volumes. Conventional approaches involve in-field drilling programs, horizontal drilling, well stimulation, and fracturing. The following U.S. patents disclose various inventions relating to fracturing: U.S. Pat. Nos. 4,391,337; 4,537,256; 6,929,066; and 7,637,317. Each one of these patents is incorporated by reference in its entirety.

Many U.S. patents disclose various inventions relating to underground perforating of casings and formations. U.S. Pat. No. 5,445,220 discloses a method for cutting openings through casing, cement and the formation rock. U.S. Pat. No. 6,854,518 discloses a method for enhancing production from an oil or gas well. U.S. Pat. No. 7,025,139 discloses a well jet device. U.S. Pat. Nos. 6,865,792 and 7,246,548 disclose well perforating guns and methods for making them. Each one of these patents is incorporated by reference in its entirety. U.S. Pat. Nos. 5,700,969 and 5,531,164 disclose jet perforating of underground well casings, using resistive blasting caps. U.S. Pat. No. 7,650,947 discloses a system for circulating, perforating and treating a well. U.S. Pat. No. 7,635,027 discloses a method and apparatus for completing a horizontal well by detonating a perforating charge. U.S. Pat. No. 7,600,562 discloses a non-explosive tubing perforator and method of perforating. U.S. Pat. No. 7,357,182 discloses a method and apparatus for completing a lateral channel from an existing oil or gas well. The device includes a well perforating tool for perforating a well casing at a preselected depth, and a lateral alignment tool for directing a flexible hose and blaster nozzle through a previously made perforation in the casing to complete the lateral channel. Each one of these patents is incorporated by reference in its entirety.

.While these methods may apply to large fields with thick contiguous pay sands, there are many fields with thinner sand sections or lower flow rates where the potential production increase will not justify such procedures. Other types of radial or lateral blasting have failed to penetrate the formation around a well bore successfully due to lack of high pressure and volume of fluid, lack of integrity in the flexible hose to maintain direction, and lack of ability to create circulation and remove cuttings as lateral holes in the formation are established.

U.S. Pat. Nos. 7,527,092 and 7,546,876 both disclose a method and apparatus for down hole abrasive jet-fluid cutting. U.S. Pat. Nos. 7,527,092 and 7,546,876 are incorporated by reference in their entirety. The apparatus includes a jet-fluid nozzle and a high pressure pump capable of delivering a high-pressure abrasive fluid mixture to the jet-fluid nozzle, an abrasive fluid mixing unit capable of maintaining and providing a coherent abrasive fluid mixture, a tube to deliver the high pressure coherent abrasive mixture down hole to the jet-fluid nozzle, a jetting shoe adapted to receive the jet-fluid nozzle and directing abrasive jet-fluid mixture towards a work piece, a jetting shoe controlling unit that manipulates the jetting shoe along a vertical and horizontal axis and a central processing unit having a memory unit capable of storing profile generation data for cutting a predefined shape or window profile in the work piece and coordinating the operation of various subsystems. Users of the devices described in these two patents have observed breakdowns of the described inventions, including: failure of the abrasive jetting system being able to navigate the ninety-degree angle in the deflection shoe without cutting through the shoe; inability to penetrate the formation after having cut through the deflection shoe; clogging of the formation when using abrasives to cut the formation, the flexible hose crimping under pressure from the coiled tubing, abrasive environments having a negative impact on the life of the jetting nozzle at the end of the flexible hose, and expansion of the flexible hose, impeding its ability to move through the deflection shoe.

In light of the foregoing, a need remains for an apparatus having an improved deflection shoe, and improved flexible hose, for blasting lateral holes in the formation around a well bore.

BRIEF SUMMARY OF THE INVENTION

A system for blasting lateral holes in the formation around a well bore, the well bore containing production casing, and production tubing within the production casing, the system comprising: a coiled tubing system comprising: (i) a first pump for pumping under pressure cutting fluid; (ii) coiled tubing for inserting into the production tubing; (iii) a double-braided stainless steel flexible hose having first and second ends, the first end attached to the bottom end of the coiled tubing, the hose having an operating pressure of 5,000 psi and a burst pressure of 10,000 psi; (iv) a jetting nozzle attached to the second end of the flexible hose; and (v) a deflection shoe adapted for attaching to the bottom of the production tubing, the deflection shoe having openings to receive fluid, and having rollers for guiding the jetting nozzle at a ninety-degree angle from the production tubing and into the formation. The system further comprises a centering system for centering the coiled tubing within the production tubing; a fluid transport system comprising a second pump and tubing adapted for pumping circulating fluid through the production casing and through the deflection shoe; and a flow-back system comprising tubing adapted for receiving spent cutting fluid out of the production casing. The first pump is adapted for pumping at a pressure between two and five thousand psi the cutting fluid through the coiled tubing, through the flexible hose, and into the formation, and the second pump is adapted for pumping the circulating fluid through the production casing and through the deflection shoe.

DETAILED DESCRIPTION OF THE INVENTION

Figure 1:
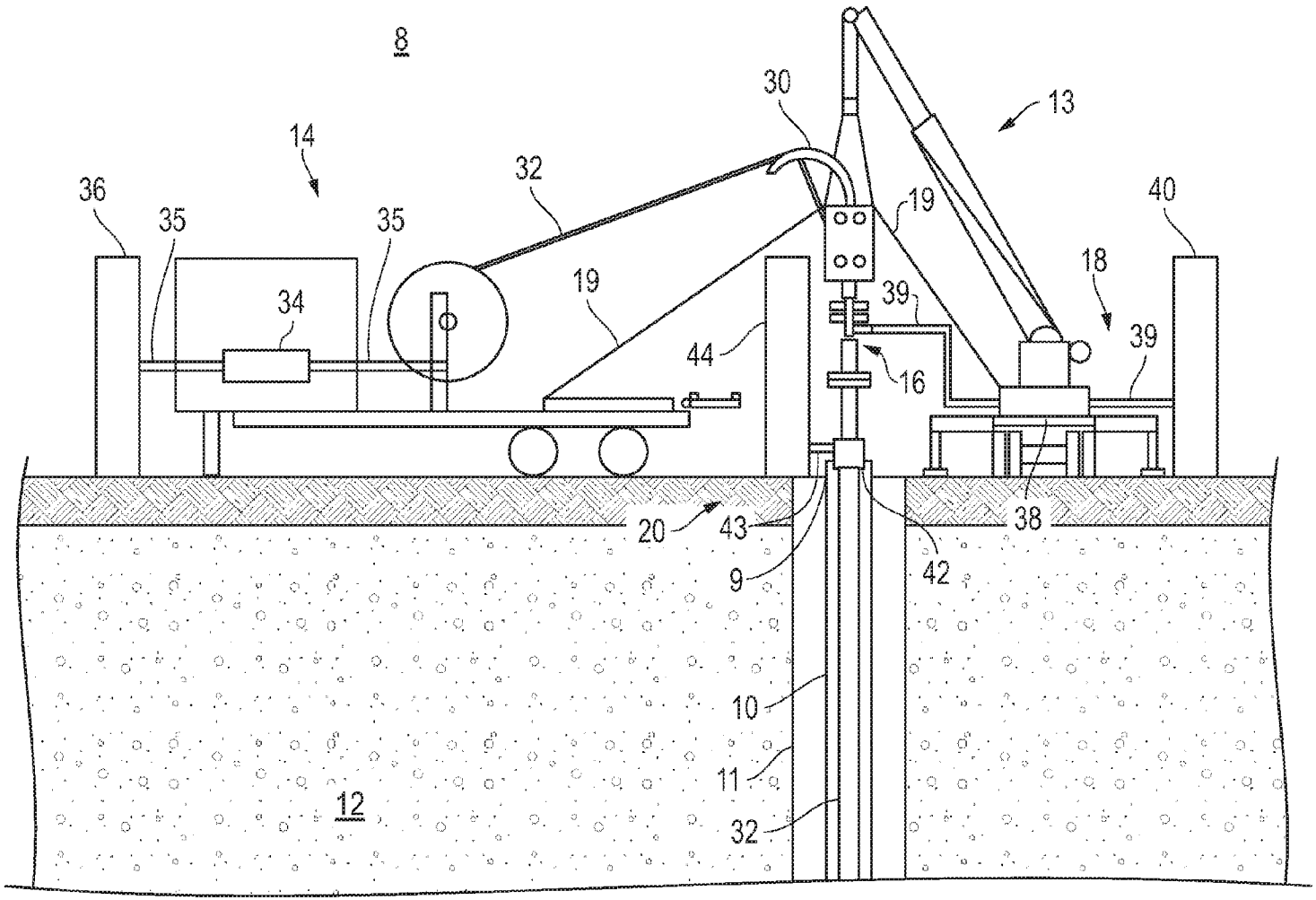
FIG. 1 is an overview diagram showing a system for blasting lateral holes in an existing well bore.

In FIG. 1, a blasting system 8 for blasting lateral holes in an existing well bore is connected to a well head fitting 9, which in turn is connected to production tubing 10 inside of production casing 11, within a well bore, which in turn is in a formation 12. In the preferred embodiment, the production tubing 10 has a two and three-eighth inch outside diameter, and a two inch inside diameter. The blasting system 8 includes a crane truck 13, a coiled tubing system 14, a centering system 16, a water transport system 18, tie-down chains 19, and a flow-back system 20. The crane truck 13 includes a boom to hoist and lower the coiled tubing down into the production casing 11, and is mainly used for positioning, and maintaining the stability of, the coiled tubing as it is lowered vertically down the well bore.

The coiled tubing system 14 includes a goose neck 30 which feeds coiled tubing 32, which has a one-inch outside diameter, through the centering system 16 into the production tubing 10. The coiled tubing system 14 also includes a pump 34, tubing 35, and an acid storage unit 36, which are used to pump an acid solution 37, also referred to as the cutting fluid 37 (shown in FIG. 2) through the coiled tubing 32 into the production casing 11. The pumping pressure in the coiled tubing 32 varies from one to twenty-thousand psi, and the pump 34 pumps one-half barrel per minute through the coiled tubing 32, and three barrels per minute through the production tubing 10.

The water transport system 18 pumps water into the production tubing 10 through the well head fitting 9. This provides needed circulation around the outside of the coiled tubing 32 as fluids are pumped through the coiled tubing 32. The water transport system 18 includes a pump 38, tubing 39, and a water storage unit 40, for storing circulation fluid 41 (shown in FIG. 2). In the preferred embodiment, the pump 38 has at least 170 horsepower, preferably 220 horsepower, with a flow rate of at least six barrels per minute. This provides enough pressure and flow to push the spent cuttings back up through the annulus, around the production tubing, to the surface. The flow-back system 20 includes tubing 43 and a storage unit 44, for storing flow-back fluid 45 (shown in FIG. 2).

Figure 2:
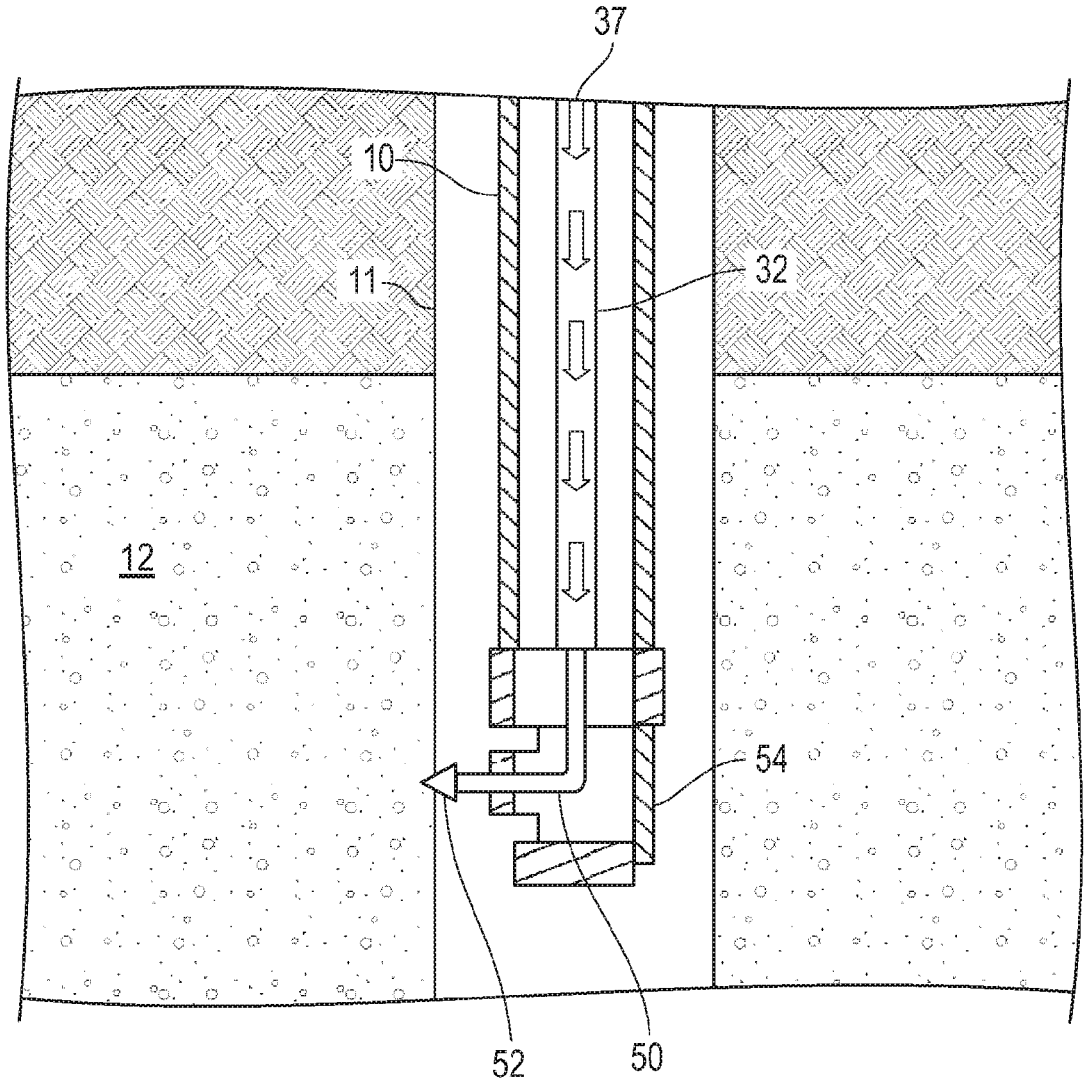
FIG. 2 is a schematic diagram showing the flow of cutting fluid through coiled tubing which has been inserted into production casing.

Referring now to FIG. 2, the coiled tubing system 14 further includes a short double-braided stainless steel flexible hose 50 connected with a coupling (not shown) at a first end of the hose 50 to the end of the coiled tubing 32. The hose 50 is purchased from U.S. Hose Corporation, Houston, Tex.; item OPNCSM400872. The hose 50 is rated at 5,000 psi operating pressure and 10,000 psi burst pressure, and has an outside diameter of one-half inch. Crimped onto a second end of the short stainless steel flexible hose 50 is a jetting nozzle 52. The coiled tubing system 14 further includes a deflection shoe 54 which is screwed onto the bottom end of the production tubing 10. The jetting nozzle 52 can be stainless steel, but it has been found that a ceramic nozzle 52 is more resistant to the negative effects of the cutting fluid 37.

Figure 3:
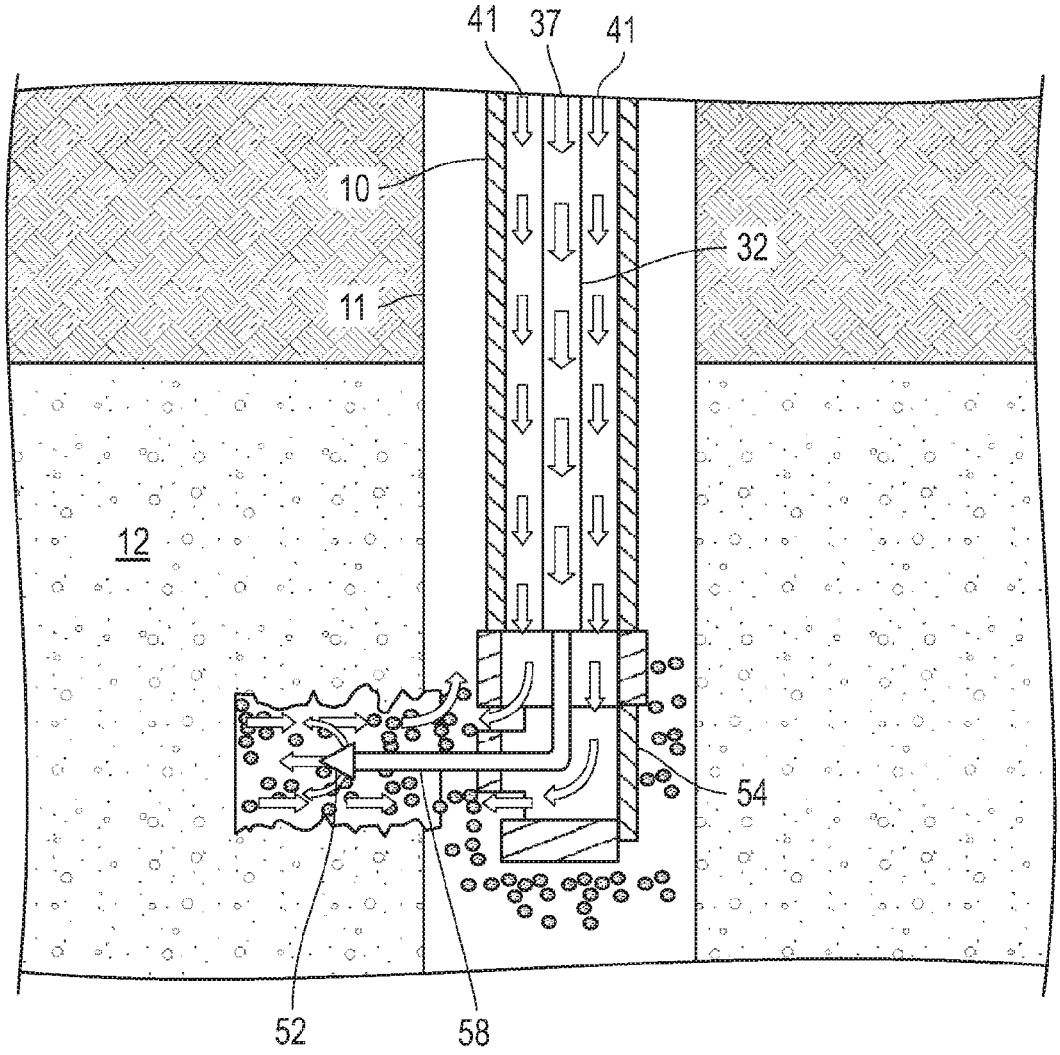
FIG. 3 is a schematic diagram showing the flow of cutting fluid through the coiled tubing and through a flexible hose, and showing the flow of circulation fluid through the production casing.

Referring now to FIG. 3, in operation, the coiled tubing 32 with the short hose 50 is lowered through the deflection shoe 54, and blasting is commenced to drill a horizontal pilot hole 56 approximately six to twelve inches in length. The pilot hole helps to achieve a good lateral extension in the correct direction, particularly if multiple laterals are to be blasted at the same vertical depth. In the preferred method of the present invention, the cutting fluid 37 is pumped at a pressure between 2,500 and 3,000 psi through the coiled tubing 32, and thus through the hose 50, and at a rate of thirty-five to forty gallons per minute, which makes the hose 50 rigid.

Figure 4:
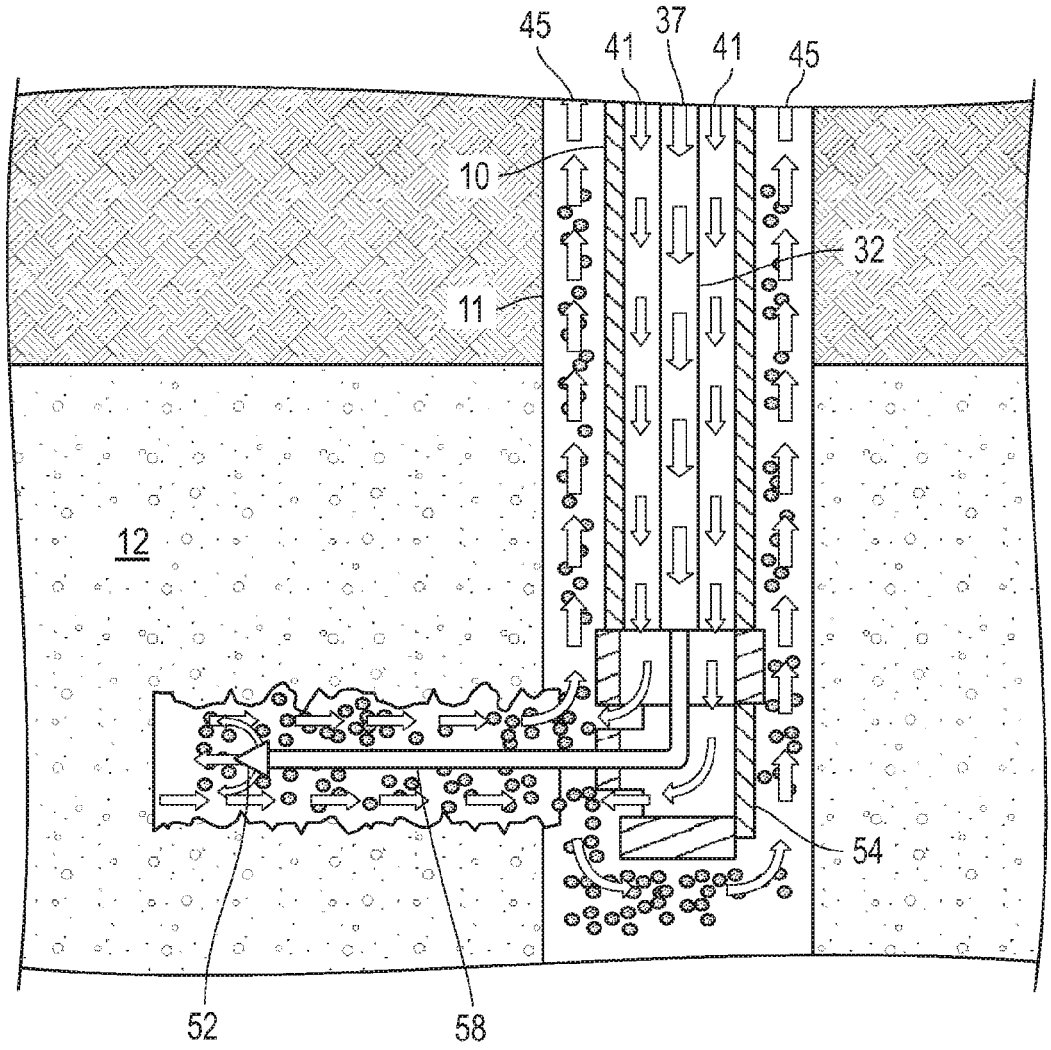
FIG. 4 is a schematic diagram showing the flow of cutting fluid through the coiled tubing and through a flexible hose, showing the flow of circulation fluid through the production casing, and showing the flow of flow-back fluid through the well bore.

Referring now to FIG. 4, after the pilot hole 56 is drilled, the short hose 50 is replaced with another double-braided stainless steel flexible hose 58 of the desired length, also having a jetting nozzle 52 attached to it. In the preferred embodiment, the hose 58 is purchased from Hosexpress, Inc., Orange, Tex., and is ninety feet long. The hose 58 is also rated at 5,000 psi operating pressure and 10,000 psi burst pressure, and has an outside diameter of one-half inch. Then blasting is recommenced through the pilot hole by inching forward, and pulling back on the coiled tubing 32, while simultaneously allowing the cutting fluid 37 under pressure to blast out through the hose 58 and the jetting nozzle 52, to do its work on the formation. After the coupling attached to the top end of the hose 58 reaches the top end of the deflection shoe 54, the operator knows that a complete penetration of about ninety feet into the formation 12 has been accomplished. A rate of penetration appropriate to the formation 12 is set, and blasting proceeds at a defined rate depending on the formation 12. For example, a rate of penetration of approximately one and one-half inches per minute is appropriate for limestone. In the preferred method of the present invention, the cutting fluid 37 is pumped at a pressure between 2,500 and 3,000 psi through the coiled tubing 32, and thus through the hose 58, and at a rate of thirty-five to forty gallons per minute, which makes the hose 58 rigid. Simultaneously, the flow-back fluid, also referred to as spent cutting fluid 45 is being pushed out of the horizontal section 60 into the annulus of the production casing 11, and finally up into the flow-back storage unit 44 (shown in FIG. 1). The spent cutting fluid 45 is then routed to mud pits. Lateral displacement in the horizontal section 60 is achieved by a combination of fluid pressure and acid dissolution, in the case of carbonate rock formations.

The final step of the process is to slowly raise the coiled tubing 32, thus bringing the hose 58 back along the length of the horizontal section 60, and flush out the horizontal section 60 with the same acid solution used to do the blasting, but now at a lower pressure, and at a flow rate of approximately three to five gallons per minute. The coiled tubing 32 is then continued to be raised until it is completely brought to the surface, including the attached hose 58. The process, beginning with attaching the short hose 50 attached to the coiled tubing 32, may be repeated as many times as desired by the operator, both vertically and horizontally. Generally no more than four laterals are attempted at any particular depth, to ensure integrity of the well bore. To move the blasting direction ninety degrees from the horizontal section 60, the production tubing 10 is manually turned ninety degrees clockwise at the well head fitting 9.

Figure 5:
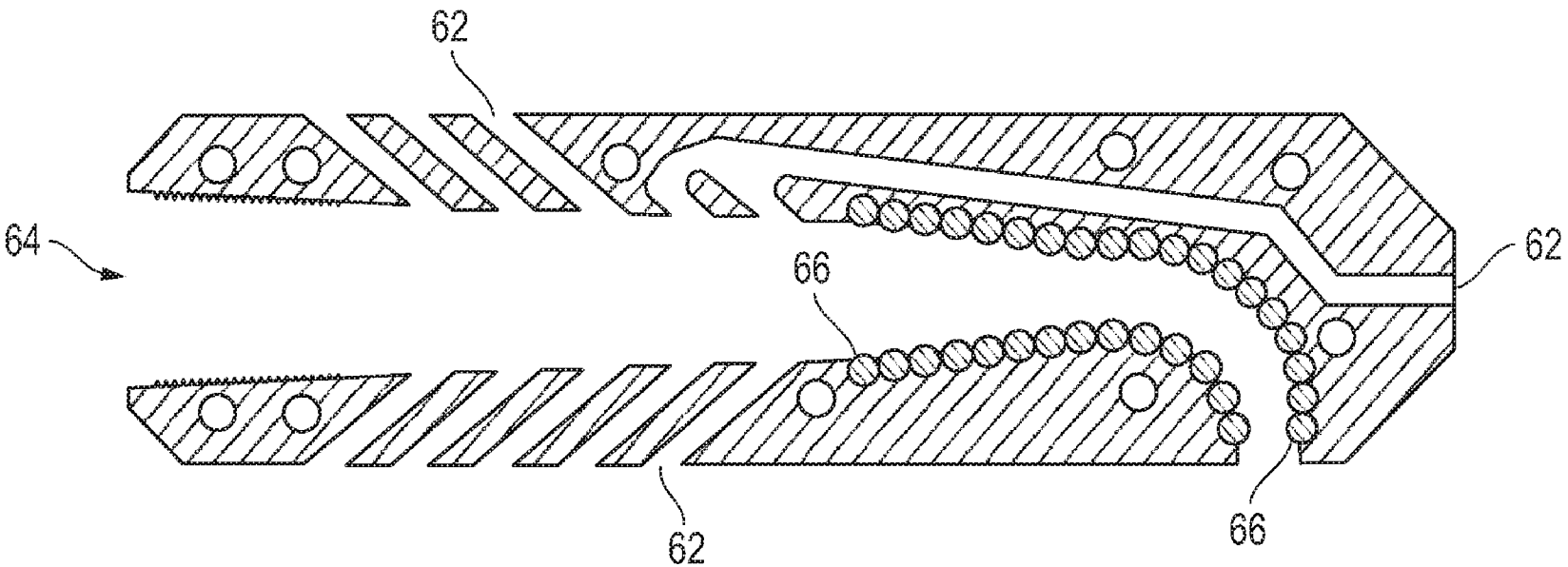
FIG. 5 is a depiction of the deflection shoe used to guide the hose into the formation around the well bore.

Referring now to FIG. 5, as previously described, the deflection shoe 54 includes aspiration channels 62 for circulating the circulating fluid 41 in the deflection shoe 54 to aid in the movement of the hoses 50 and 58 through the shoe 54. In the preferred embodiment, the deflection shoe 54 has five on either side. In the preferred embodiment, the aspiration channels 62 are about eight-tenths of an inch in diameter. On one of the two sides of the deflection shoe 54, two of the aspiration channels 62 join together to form one long aspiration channel that exits out the bottom end of the deflection shoe 54. The deflection shoe 54 also includes a top end 64 which is screwed onto the production tubing 10. In the preferred embodiment, the top end 64 has an inside diameter of about three and four-tenths inches. The interior space of the shoe 54 gradually narrows to a diameter of about two and a half inches, at which point roller bearings 66 are embedded in the walls of the interior space. The roller bearings 66 guide the hose 50 for blasting the horizontal pilot hole 56, and also guide the hose 58 for blasting the horizontal section 60. In the preferred embodiment, the roller bearings 66 are placed in a gradually narrowing interior space, that is, from a diameter of about two and a half inches to a diameter of about one and two-tenths inches at the point that the hoses 50 and 58 exit the shoe 54. In the preferred embodiment, the deflection shoe 54 has fourteen roller bearings 66 on one side of the interior space, and nineteen roller bearings 66 on the opposite side of the interior space.

Although in the preferred embodiment, the hose 58 has been described as having a maximum length of ninety feet, it can be any length. Also, the diameters of the production tubing 10, the coiled tubing 32, and the hose 58 can all vary, depending on the physical properties of the well bore and the surrounding formation 12.

The invention as herein described was first tested at a well depth of approximately three hundred feet, resulting in two separate fifty-foot laterals in each of two gas wells located near Abilene, Tex. Each lateral extension was positioned at 180 degrees from each other into the targeted producing sand. As a result, the initial production of the first well increased five-fold, and the initial production of the second well increased twelve-fold.

Later, the method of the present invention was tested in two newly-drilled wells in Austin Chalk, to a vertical depth of about 2,700 feet. The method of the present invention successfully blasted a total of 20 laterals, up to ninety feet in length, at three separate depths, in the two wells. The laterals were cut at a rate of approximately one and a half feet per minute using water, acid, and certain other additives, under a pressure of approximately 3,000 psi.

The invention claimed is:

1. A method of blasting lateral holes in a formation around a well bore, the well bore containing production casing, and production tubing within the production casing, the method comprising the steps of:

(a) removing the production tubing from the production casing;

(b) attaching a ninety-degree deflection shoe to the bottom of the production tubing, the deflection shoe having openings to receive fluid, and having rollers for guiding a hose at a ninety-degree angle from the production tubing and into the formation;

(c) attaching a short double-braided stainless steel flexible hose to a first end of coiled tubing, the hose having an operating pressure of 5,000 psi and a burst pressure of 10,000 psi;

(d) reinserting the production tubing into the production casing;

(e) centering the coiled tubing over the production tubing;

(f) forcing the short flexible hose, attached to the coiled tubing, down to the bottom of the production tubing, and into the deflection shoe, while simultaneously forcing circulating fluid down through the production casing;

(g) forcing cutting fluid under pressure between 2,000 and 5,000 psi through the coiled tubing and thus through the short flexible hose, thus creating a pilot hole in the formation, and creating spent cutting fluid, while simultaneously forcing circulating fluid down through the production casing;

(h) extracting the coiled tubing and the short flexible hose from the production tubing, while simultaneously forcing circulating fluid down through the production casing;

(i) replacing the short flexible hose with a long double-braided stainless steel flexible hose, the long hose having an operating pressure of 5,000 psi and a burst pressure of 10,000 psi;

(j) forcing the long flexible hose, attached to the coiled tubing, down to the bottom of the production tubing and into the deflection shoe, while simultaneously forcing circulating fluid down through the production casing;

(k) forcing cutting fluid under pressure between 2,000 and 5,000 psi through the coiled tubing and thus through the long flexible hose, thus blasting a lateral hole in the formation, and creating spent cutting fluid, while simultaneously forcing circulating fluid down through the production casing; and (l) extracting the coiled tubing and the long flexible hose from the production tubing, while simultaneously forcing cutting fluid under low pressure through the coiled tubing and thus through the long flexible hose, and while simultaneously forcing circulating fluid down through the production casing.

2. The method according to claim 1, wherein the pilot hole is approximately six to twelve inches in length.

3. The method according to claim 1, wherein the pressure of the cutting fluid is between two and three thousand psi.

4. The method according to claim 1, wherein the circulating fluid is pumped into the production casing at the rate of three barrels per minute.

5. A system for blasting lateral holes in a formation around a well bore, the well bore containing production casing, and producting tubing within the production casing, the system comprising:

(a) a coiled tubing system comprising:

(i) a first pump for pumping under pressure cutting fluid;

(ii) coiled tubing for inserting into the production tubing;

(iii) a double-braided stainless steel flexible hose having first and second ends, the first end attached to a bottom end of the coiled tubing, the hose having an operating pressure of 5,000 psi and a burst pressure of 10,000 psi;

(iv) a jetting nozzle attached to the second end of the flexible hose; and (v) a deflection shoe adapted for attaching to the bottom of the production tubing, the deflection shoe having openings to receive fluid, and having roller bearings for guiding the jetting nozzle at a ninety-degree angle from the production tubing and into the formation;

(b) a centering system for centering the coiled tubing within the production tubing;

(c) a fluid transport system comprising a second pump and tubing adapted for pumping circulating fluid through the production casing; and (d) a flow-back system comprising tubing adapted for receiving spent cutting fluid out of the production casing;

wherein the first pump is adapted for pumping at a pressure between two and five thousand psi the cutting fluid through the coiled tubing, through the flexible hose, and into the formation, and the second pump is adapted for pumping the circulating fluid through the production casing and through the deflection shoe.

6. The system according to claim 5, wherein the first pump is adapted for pumping the cutting fluid at a pressure between two and three thousand psi.

7. The system according to claim 5, wherein the second pump is adapted for pumping the circulating fluid at a rate of three barrels per minute.

* * * * *